US008943775B2

(12) United States Patent
Binns

(10) Patent No.: US 8,943,775 B2
(45) Date of Patent: Feb. 3, 2015

(54) WALL SYSTEM USING T-SHAPED BLOCKS

(76) Inventor: Michael William Binns, Parksville (CA)

( * ) Notice: Subject to any disclaimer, the term of this patent is extended or adjusted under 35 U.S.C. 154(b) by 0 days.

(21) Appl. No.: 13/261,747

(22) PCT Filed: Mar. 20, 2012

(86) PCT No.: PCT/CA2012/050173
§ 371 (c)(1),
(2), (4) Date: Sep. 23, 2013

(87) PCT Pub. No.: WO2012/126116
PCT Pub. Date: Sep. 27, 2012

(65) Prior Publication Data

US 2014/0026511 A1 Jan. 30, 2014

(30) Foreign Application Priority Data

Mar. 23, 2011 (CA) ..... 2735351

(51) Int. Cl.
*E02D 29/02* (2006.01)

(52) U.S. Cl.
USPC ..... 52/611; 52/565; 52/562; 52/606

(58) Field of Classification Search
USPC ..... 52/561, 562, 566–572, 582.1, 586.1, 52/596, 600, 606–607, 611–612, 146, 155, 52/745.19, 745.03, 563–565, 601–605, 52/608–609, 747.1; 405/262, 284
See application file for complete search history.

(56) References Cited

U.S. PATENT DOCUMENTS 1,553,004 A * 9/1925 Packard ..... 122/6 A
1,657,453 A * 1/1928 Boyd ..... 52/506.03
1,798,331 A * 3/1931 Liptak ..... 52/562
2,185,497 A * 1/1940 Cilento et al. ..... 52/98
3,815,368 A 6/1974 Turzillo
3,956,862 A * 5/1976 Alexandre, Jr. ..... 52/286
4,123,881 A * 11/1978 Muse ..... 52/100
4,802,320 A 2/1989 Forsberg (Continued)

FOREIGN PATENT DOCUMENTS

GB 188990 A 11/1922
GB 561974 A 6/1944

(Continued)

OTHER PUBLICATIONS

International Search Report and Written Opinion mailed Jul. 13, 2012, issued in corresponding International Application No. PCT/CA2012/050173, filed Mar. 20, 2012, 6 pages.

*Primary Examiner* — Jeanette Chapman

(74) *Attorney, Agent, or Firm* — Christensen O'Connor Johnson Kindness PLLC

(57) ABSTRACT

A block wall system includes a plurality of T-shaped blocks having a head defining projecting load shoulders and a shaft having a first end attached to the head and a second end. There is also provided a plurality of complementary blocks having a first end and a second end. Each of the complementary blocks is shaped to fit securely between a pair of adjacent T-shaped blocks with the first end of each complementary block abutting the load shoulders of the T-shaped blocks to limit relative movement in a first axial direction. The preferred form to have the shaft of the T-shaped blocks wedge shaped and for the complementary blocks is to be wedge blocks. The wedge engagement between the wedge shaped shaft and the wedge blocks limits movement in a second axial direction.

17 Claims, 9 Drawing Sheets

(56) References Cited

U.S. PATENT DOCUMENTS

| | | | | |
|---|---|---|---|---|
| 4,920,712 | A | 5/1990 | Dean, Jr. | |
| 5,551,809 | A | 9/1996 | Forsberg | |
| 5,622,456 | A | 4/1997 | Risi | |
| 5,788,423 | A | 8/1998 | Perkins | |
| 5,865,006 | A | 2/1999 | Dawson | |
| 5,921,715 | A * | 7/1999 | Rainey | 405/262 |
| 6,149,352 | A | 11/2000 | MacDonald | |
| 6,652,196 | B1 | 11/2003 | Rainey | |
| 6,745,537 | B1 * | 6/2004 | Hamilton | 52/574 |
| 2008/0047218 | A1 * | 2/2008 | Abella | 52/600 |

FOREIGN PATENT DOCUMENTS

| | | | |
|---|---|---|---|
| JP | 6-93624 | A | 4/1994 |
| WO | WO 2006053224 | A2 * | 5/2006 |

* cited by examiner

WALL SYSTEM USING T-SHAPED BLOCKS

FIELD

The present invention relates to a block wall system.

BACKGROUND

Block wall systems are often installed on embankments to provide a barrier to slippage and movement or are installed as ornamental additions during landscaping. Blocks are often stacked adjacent one another and on top of one another to create walls of varying height and length. The problem with many types of retaining walls is that blocks may shift out of alignment and create weaknesses in the wall making it ineffective.

SUMMARY

There is provided a block wall system includes a plurality of T-shaped blocks having a head defining projecting load shoulders and a shaft having a first end attached to the head and a second end. There is also provided a plurality of complementary blocks having a first end and a second end. Each of the complementary blocks is shaped to fit securely between a pair of adjacent T-shaped blocks with the first end of each complementary block abutting the load shoulders of the T-shaped blocks to limit relative movement in a first axial direction.

The preferred form for the complementary block is a wedge shaped block, hereinafter referred to as a "wedge block". When wedge blocks are used, the shaft of each of the T-shaped blocks is wedge-shaped, with the width of the shaft being narrower at the first end than at the second end. Similarly; the width at the first end of each of the wedge blocks is wider than the width at the second end to make the wedge blocks shaped to fit securely between a pair of adjacent T-shaped blocks with opposed sides of the wedge block abutting the shaft of the T-shaped blocks to limit relative movement in a second axial direction.

The block wall system, as described, has increased stability over wedge blocks alone, due to the load shoulders on the head of the T-shaped blocks which serve to limit movement in the first axial direction. When wedge blocks are used, the wedge engagement serves to limit movement in the second axial direction. As will hereinafter be described, there are also a number of secondary features that can be added to further increase the stability of the block wall system.

It is preferred that transverse channels be positioned through both the shaft of the T-shaped blocks and the wedge blocks. The transverse channels are axially aligned when the T-shaped blocks and wedge blocks are interlocked. The axial alignment of the transverse channels permits an elongated reinforcement member, such as rebar, to be positioned through the axially aligned transverse channels. The presence of reinforcement members further limits axial movement in both axial directions, limits relative twisting of the blocks and, generally, stabilizes the block wall system.

It is also preferred that each of the T-shaped blocks and wedge blocks have a top engagement on a top of the blocks and a bottom engagement on a bottom of the blocks that is capable of engaging with the top engagement of an overlying block. The engagement that has been illustrated and is preferred is a step engagement profile. The step engagement profile has been selected to limit movement in a second axial direction.

It is finally preferred that each T-shaped block and wedged block have a ground anchor receiving hole for receiving a ground anchor. The ability to anchor the block wall system is increasingly of importance as the height of the block wall is increased. The ground anchor receiving hole, which will hereinafter be illustrated and described in relation to the T-shaped block, is positioned in the head of each T-shaped block and is angled downwardly from a top toward a bottom of the T-shaped block, exiting the head.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
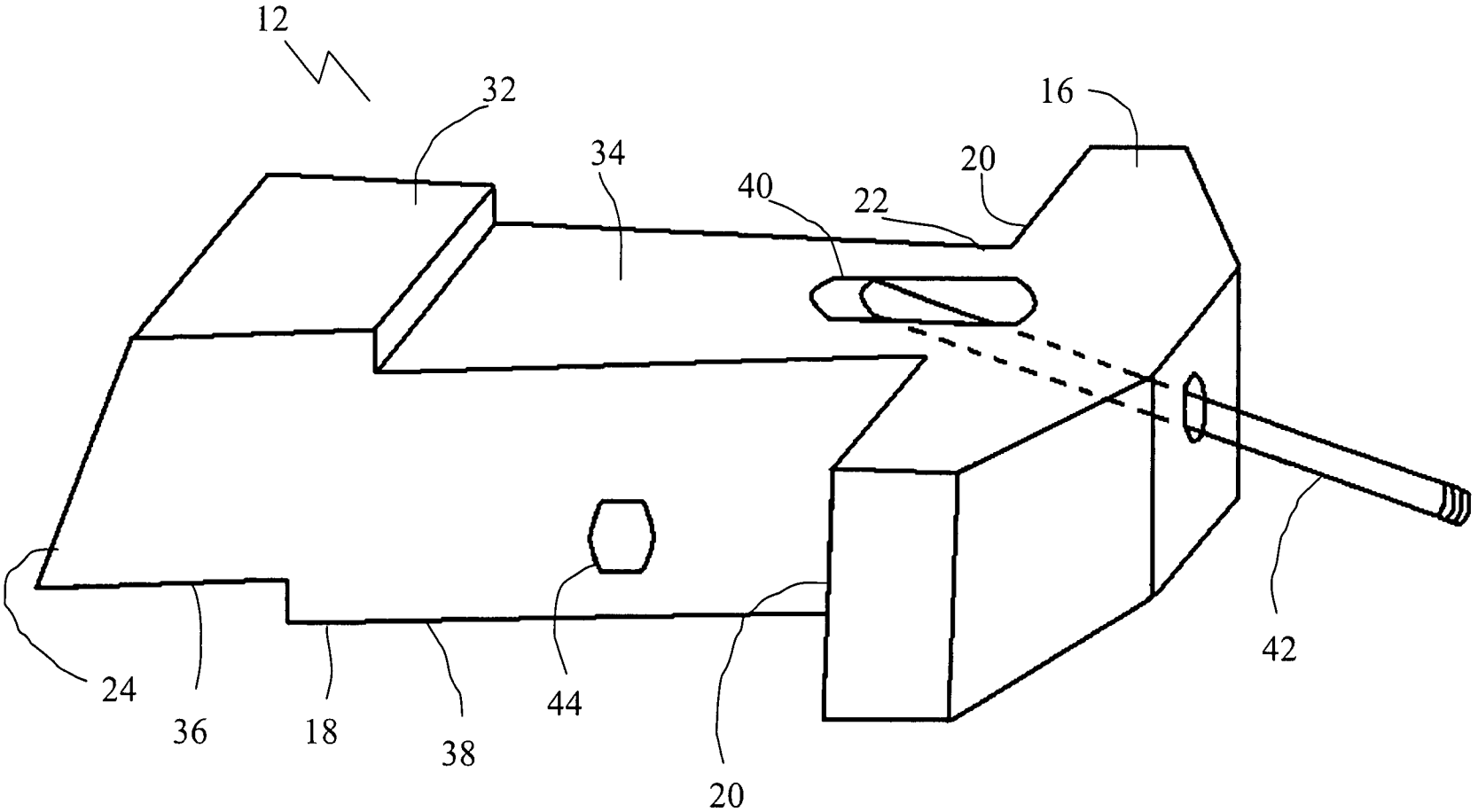
FIG. 1 is a perspective view of a T-shaped block utilized in the block wall system.

A block wall system generally identified by reference numeral 10, will now be described with reference to FIG. 1 through FIG. 9.

Figure 2:
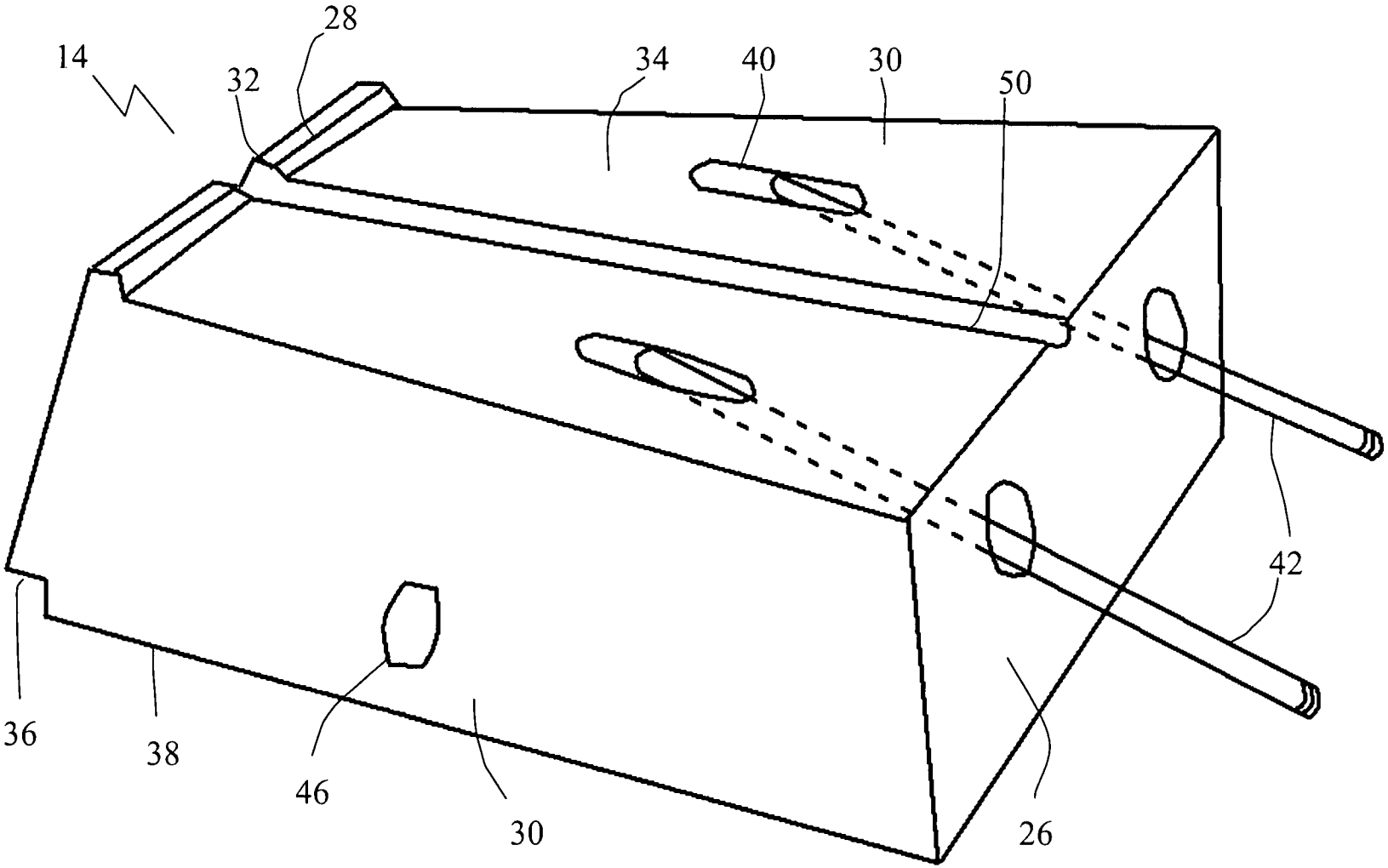
FIG. 2 is a perspective view of a wedge block utilized in the block wall system
Figure 3:
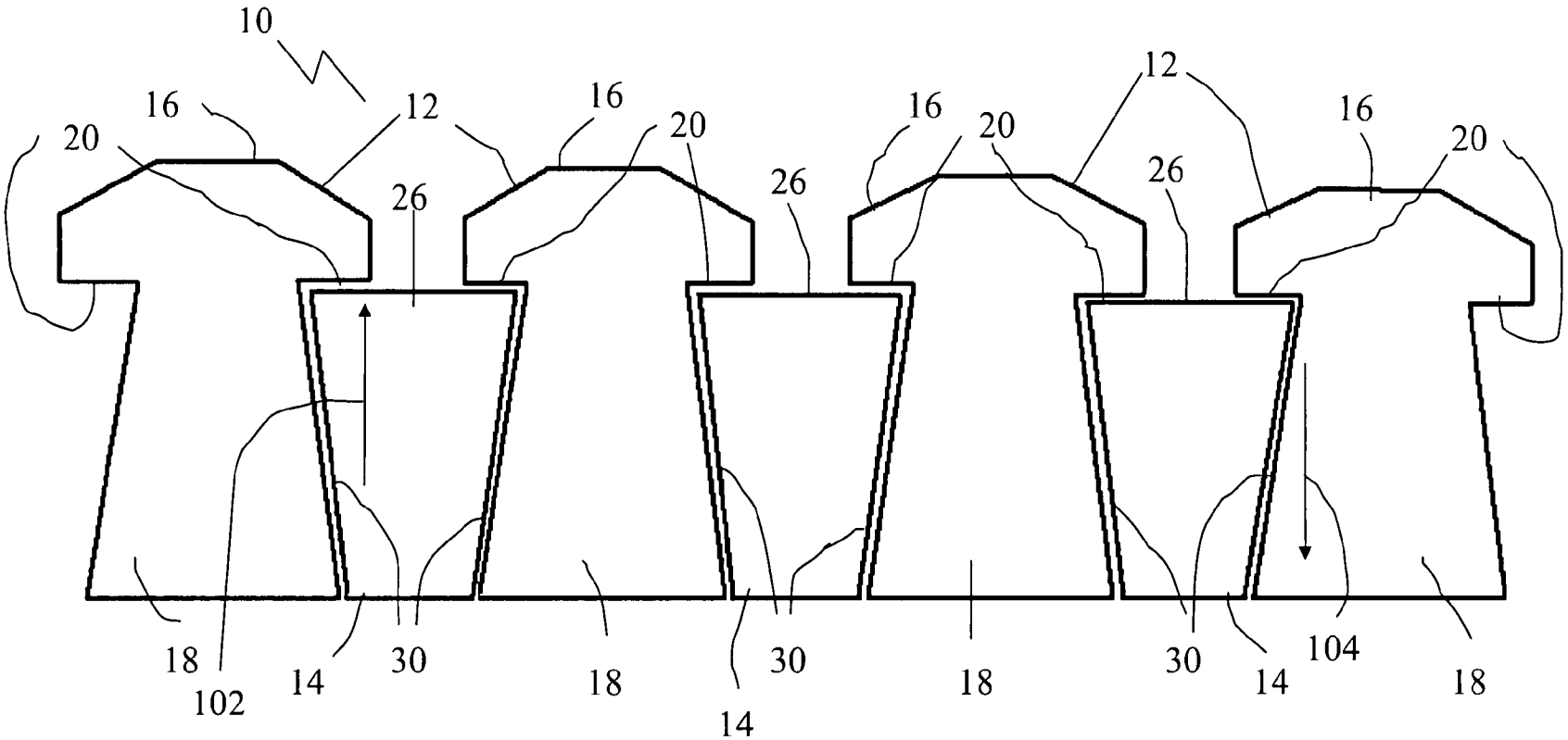
FIG. 3 is a top plan view of the t-shaped block shown in FIG. 1 and the wedge block shown in FIG. 2 arranged to form a block wall.
Figure 4:
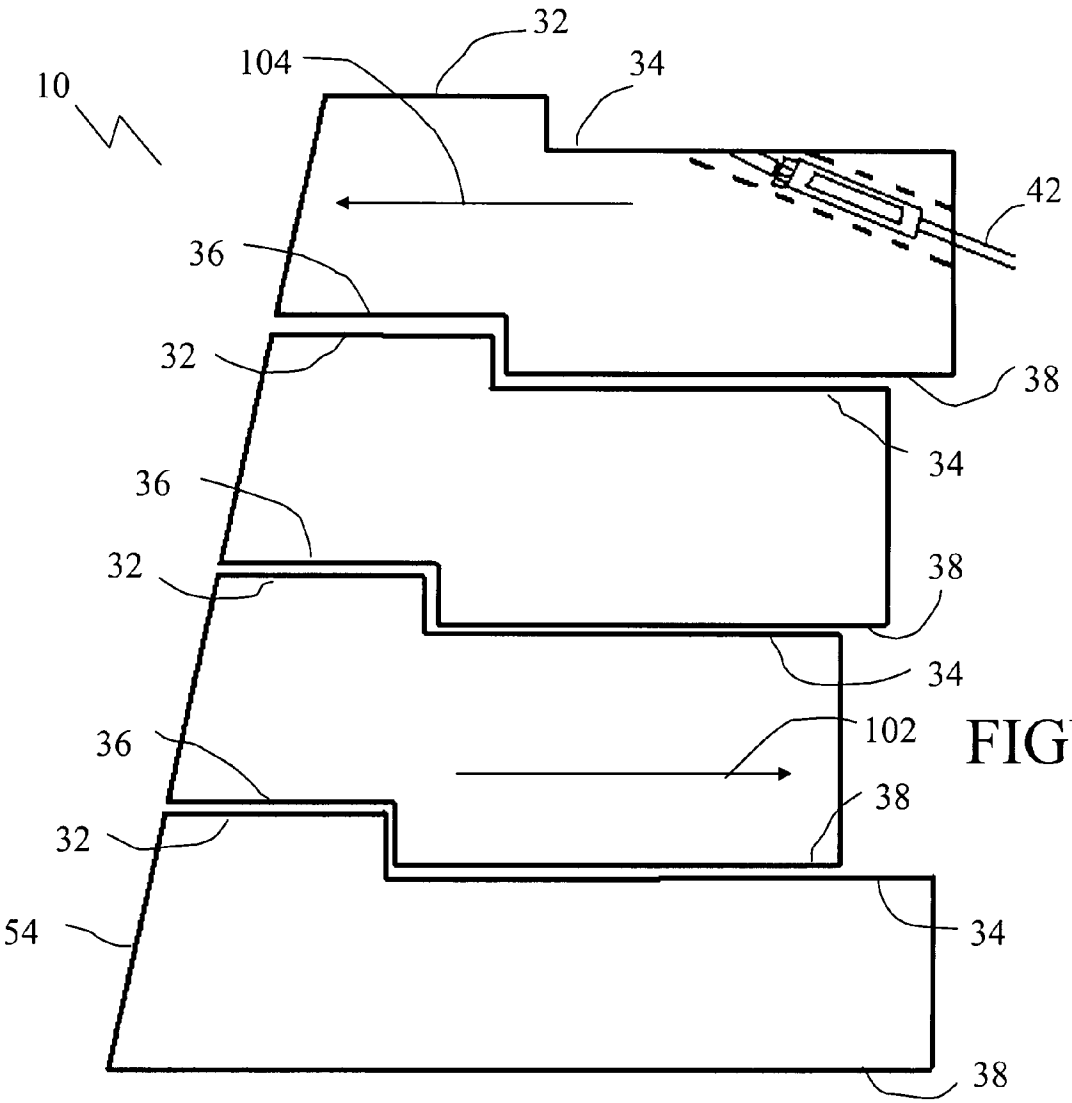
FIG. 4 is a side elevation view of blocks arranged to form a block wall.

Structure and Relationship of Parts:

Referring to FIG. 3, block wall system 10 includes a plurality of T-shaped blocks 12 and a plurality of complementary blocks 14. T-shaped blocks 12 have a head 16 and a shaft 18. Referring to FIG. 1, head 16 defines projecting load shoulders 20 and shaft 18 has a first end 22 attached to head 16 and a second end 24. Shaft 18 is wedge-shaped with the width being narrower at first end 22 than at second end 24. Referring to FIG. 2, complementary blocks 14 usually have a wedge shape with a first end 26 and a second end 28, with the width at first end 26 of complementary block 14 being wider than the width at second end 28 of complementary block 14. Referring to FIG. 3, complementary block 14 is shaped to fit securely between a pair of adjacent T-shaped blocks 12 with first end 26 of complementary block 14 abutting load shoulders 20 of T-shaped blocks 12 and opposed sides 30 of complementary block 14 abutting shaft 18 of T-shaped blocks 12. It will be understood that different shapes of complementary block 14 may be used based upon the shape of shaft 18 of T-shaped blocks 12. Referring to FIG. 4, each T-shaped block 12 and complementary block 14 have a step profile top engagement 32 on a top 34 of blocks 12, 14 and a step profile bottom engagement 36 on a bottom 38 of blocks 12, 14. When stacked, top engagement 32 of a first block will engage with bottom engagement 36 of a second block. Front face 54 of blocks may be sloped when a sloped wall is being created or may be vertical for the creation of a vertical wall. Referring to FIG. 2, complementary blocks 14 may have a channel 50 on top 34 which allows for water drainage to prevent build up of water between layers of blocks 12, 14. Referring to FIG. 1, each T-shaped block 12 may have a ground anchor receiving hole 40 extending from head 16 and angled downwardly from top 34 toward bottom 38 of T-shaped block 12 for receiving a ground anchor 42, ground anchor receiving hole 40 exiting through head 16. Complementary blocks 14 may also have a ground anchor receiving hole 40 angled downwardly from top 34 toward bottom 38, with ground anchor receiving hole 40 exiting through first end 26.

Figure 5:
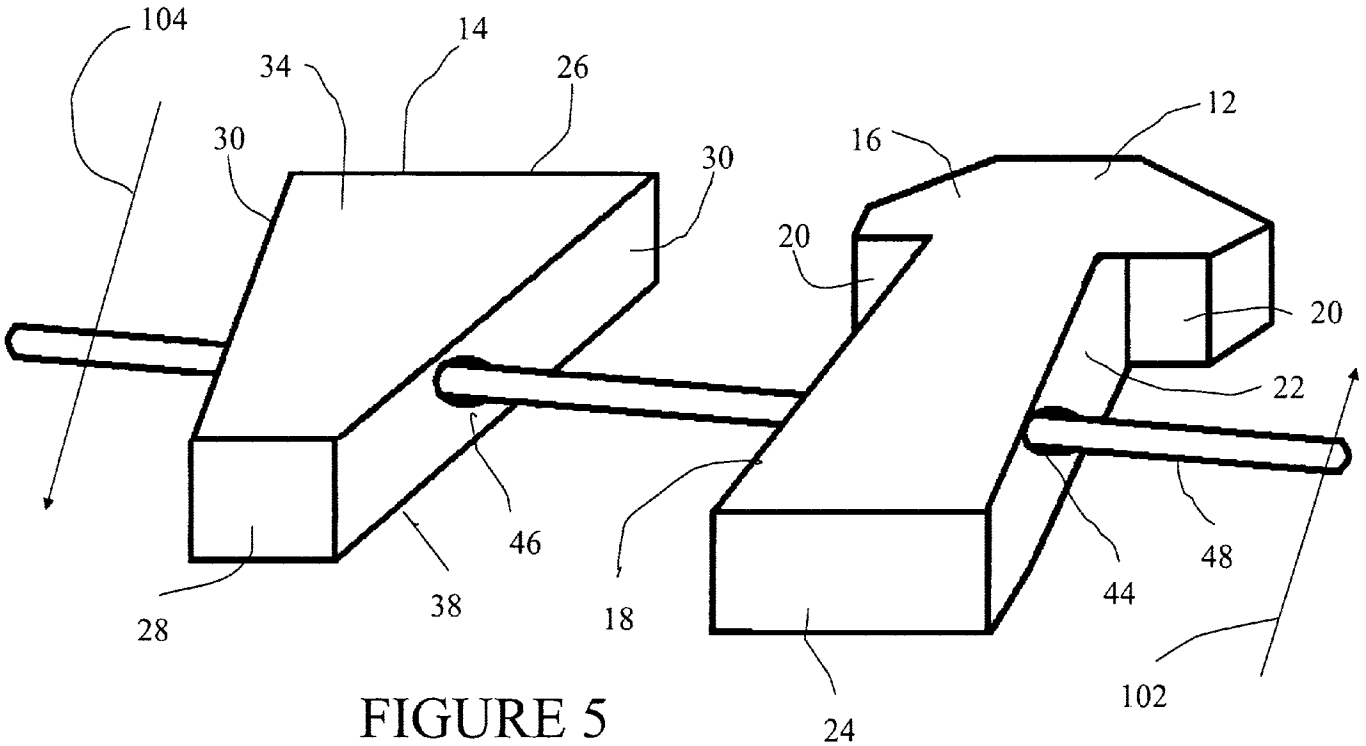
FIG. 5 is an exploded view of a wedge block with a reinforcement member.

Referring to FIG. 1, a first transverse channel 44 may be positioned in shaft 18 of T-shaped blocks 12 and, referring to FIG. 2, a second transverse channel 46 may be positioned through complementary blocks 14. First transverse channel 44 and second transverse channel 46 are axially aligned when T-shaped blocks 12 and complementary blocks 14 are interlocked. Referring to FIG. 5, an elongated reinforcement member 48, such as rebar, may be positioned through axially aligned first transverse channel 44, shown in FIG. 1, and second transverse channel 46.

Figure 8:
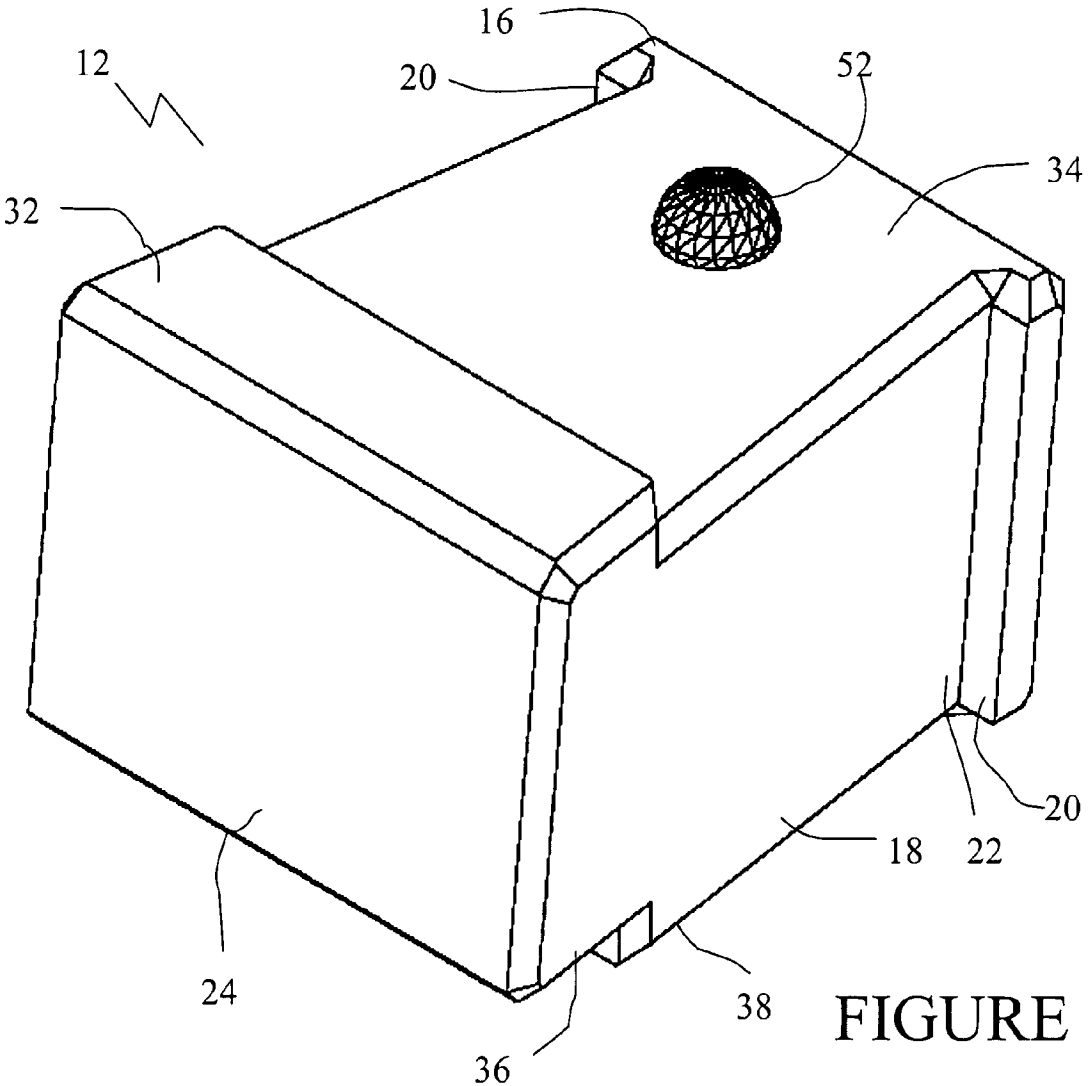
FIG. 8 is a perspective view of another example of a suitable T-shaped block.
Figure 9:
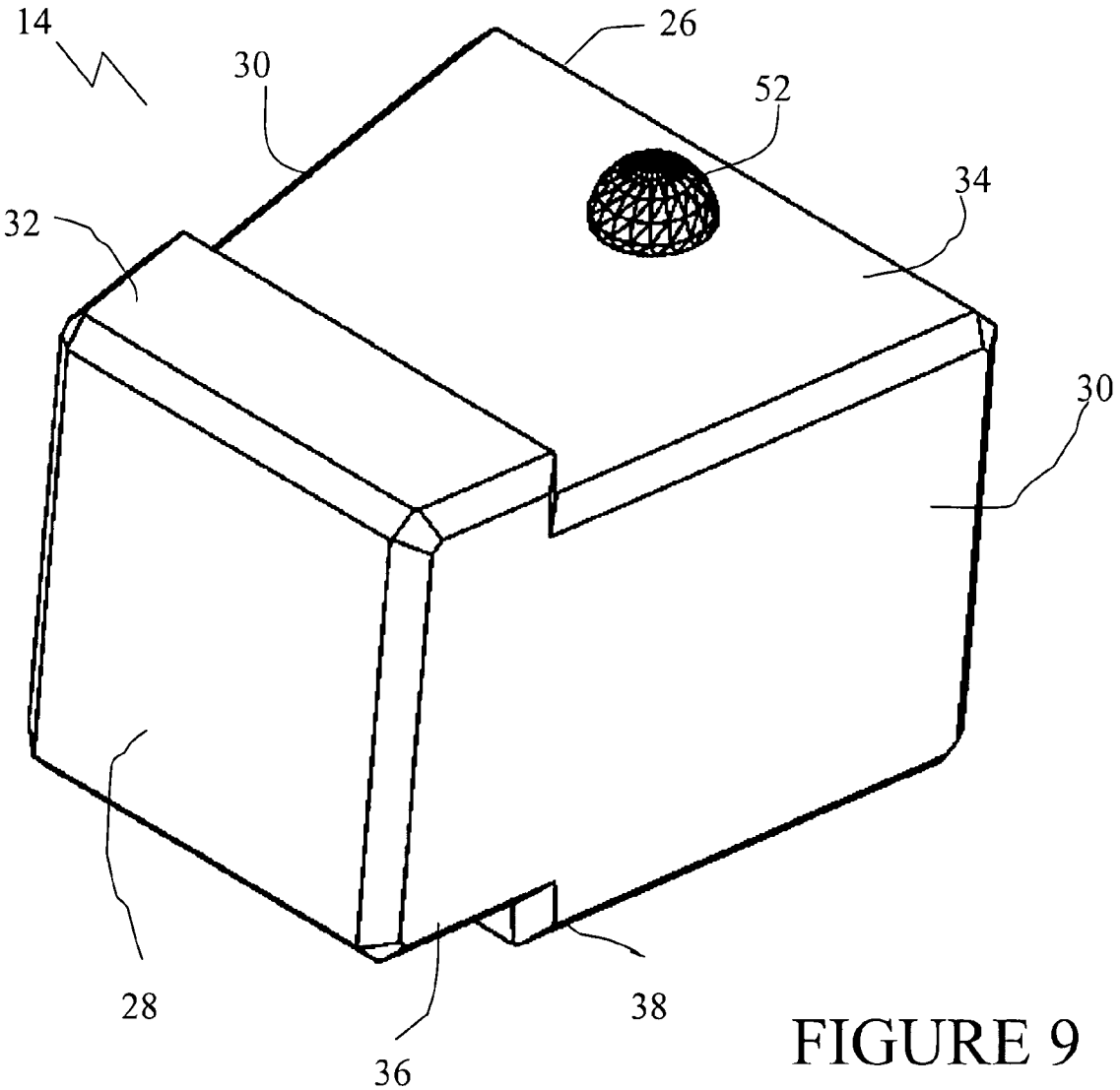
FIG. 9 is a perspective view of another example of a suitable wedge block.

Another example of suitable blocks are shown in FIG. 8 and FIG. 9. A raised semi-circular engagement 52 may be positioned on the top 34 of each of T-shaped block 12 and complementary block 14. It will be understood that the engagement 52 may be any shape. A corresponding hollow engagement, not shown, may be present on the bottom 38 of each of T-shaped block 12 and complementary block 14. Engagement 52 allows stacking of blocks 12 and 14 on top of each other while preventing blocks 12 and 14 in a stack from sliding out of position. The hollow engagement may be a discrete recess that corresponds with the size of engagement 52, or it may extend across the width of the block 12 or 14. Alternatively, instead of being semi-circular, engagement 52 and the hollow engagement may take other shapes. Engagement 52 may also extend across the width of the respective block, with a corresponding recess in the bottom of the block above. While the discrete engagement and discrete recess ensures proper alignment of blocks both front to back and side to side, a continuous recess ensures proper alignment of blocks front to back relative to the row below, and allows variation on the alignment from side to side.

Operation:

Referring to FIG. 3, a plurality of T-shaped blocks 12 and a plurality of complementary blocks 14 are used in block wall system 10. When assembled, as illustrated, first end 26 of complementary block contacts load shoulders 20 of T-shaped block 12 to limit relative movement of the blocks in a first axial direction indicated by arrow 102. In addition, opposed sides 30 of complementary blocks 14 contact shaft 18 of T-shaped blocks 12, which limits relative movement of the blocks in a second axial direction indicated by arrow 104.

Referring to FIG. 4, when stacked, top engagement 32 of each underlying block will engage with bottom engagement 36 of each overlying block, to further limit movement in second axial direction 104. A step engagement profile has been illustrated. There are other engagement profiles which may be used to accomplish this objective. The step engagement is preferred, as it is simple and reliable.

Referring to FIG. 1, ground anchors 42 may be driven through ground anchor receiving hole 40 in head 16 of each T-shaped block 12 to anchor each T-shaped block as the height of block wall system 10 increases. Ground anchors may similarly be driven through ground anchor receiving hole 40 in each complementary block 14.

Referring to FIG. 5, when T-shaped blocks 12 and complementary blocks 14 are fitted securely together, thereby aligning first transverse channel 44 and second transverse channel 46, elongated reinforcement member 48 may be positioned through first transverse channel 44 on T-shaped blocks 12 and second transverse channel 46 of complementary block 14. The presence of reinforcement member 48 limits relative twisting of T-blocks 12 and complementary blocks 14, as well as limited axial movement in both the first axial direction 102 and the second axial direction 104.

Figure 6:
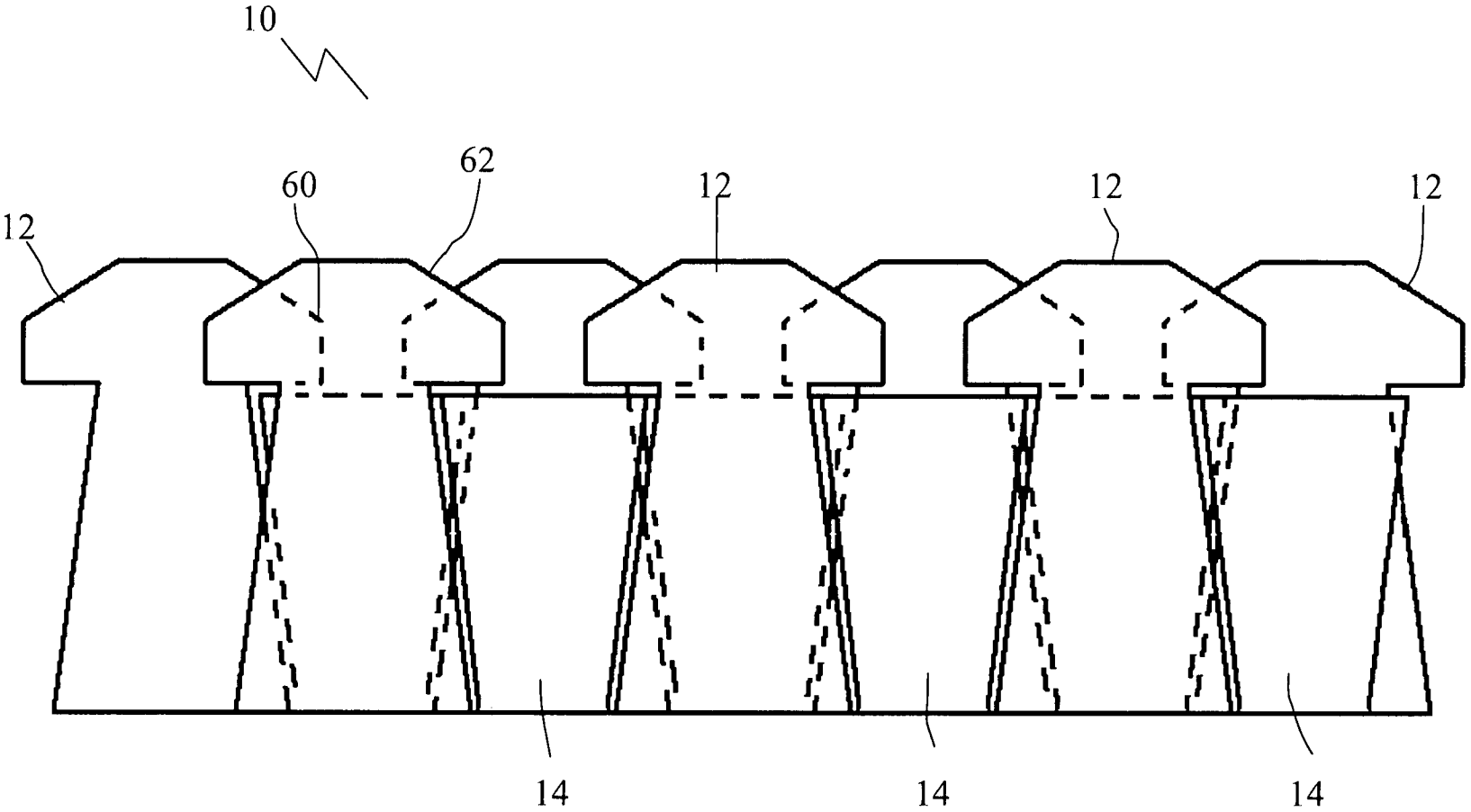
FIG. 6 is a top plan view, in section, of blocks arranged to form a block wall.
Figure 7:
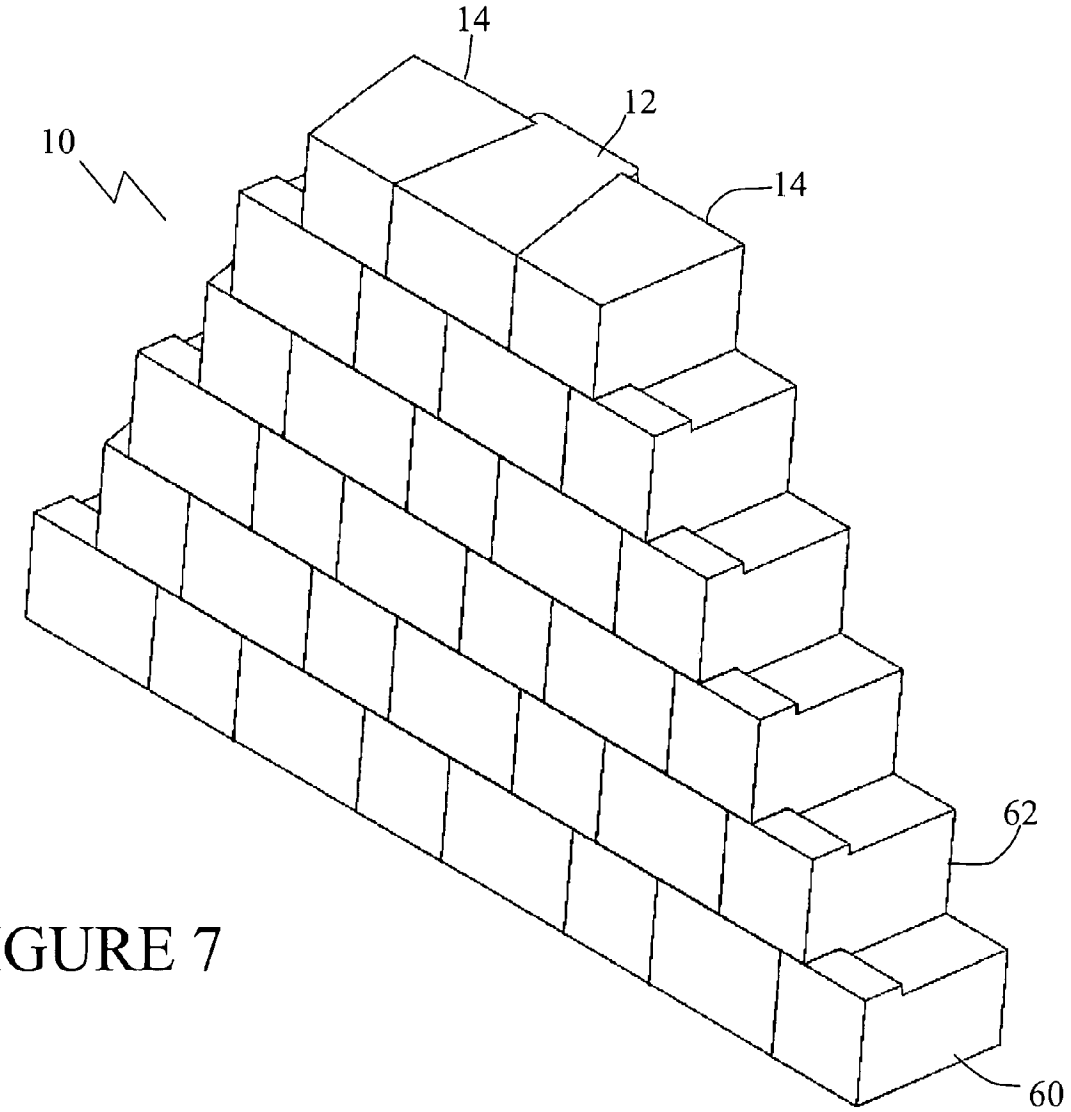
FIG. 7 is a perspective view of blocks arranged to form a block wall.

Referring to FIG. 6 and FIG. 7, when using block wall system 10 to build a wall, a first row 60 of T-shaped blocks 12 and complementary blocks 14 are placed on the ground in an alternating pattern. Each T-shaped block 12 is adjacent a complementary block 14 and vice versa. A second row 62 of T-shaped blocks 12 and complementary blocks 14 are then placed on the first row of blocks. Additional rows are added until the desired height is reached. For increased strength, T-shaped blocks 12 in second row 62 are placed on complementary blocks 14 and vice versa. The blocks 12 and 14 in each additional row may either be stacked alternating between A-shaped blocks 14 and T-shaped blocks 12 and directly above the block below as shown in FIG. 6, or be staggered as shown in FIG. 7. An advantage to having the blocks 12 and 14 stacked on top of each other is that generic end blocks can be provided that will match with the row below, reducing or eliminating the number of cuts to the blocks. Referring to FIG. 8 and FIG. 9, the engagement 52 present on these blocks 12 and 14 promote alignment and prevent sliding of blocks when the blocks are stacked on top of one another.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A block wall system, comprising:

a plurality of T-shaped blocks having a head defining projecting load shoulders and a shaft having a first end attached to the head and a second end; and a plurality of complementary blocks having a first end and a second end, each of the complementary blocks being shaped to fit securely between a pair of adjacent T-shaped blocks with the first end of each complementary block abutting the load shoulders of the T-shaped blocks to limit relative movement in a first axial direction, wherein the shaft of each of the T-shaped blocks is wedge-shaped with the width of the shaft being narrower at the first end than at the second end, and the width at the first end of the complementary blocks being wider than the width at the second end, the complementary blocks being shaped to fit between a pair of adjacent T-shaped blocks with opposed sides of the wedge block abutting the shaft of the T-shaped blocks to limit relative movement in a second axial direction.

2. The block wall system of claim 1, wherein a first transverse channel is positioned in the shaft of the T-shaped blocks and a second transverse channel is positioned through the complementary blocks, the first transverse channel and the second transverse channel being axially aligned when the T-shaped blocks and complementary blocks are interlocked.

3. The block wall system of claim 2, wherein an elongated reinforcement member is positioned through the axially aligned first transverse channel and second transverse channel.

4. The block wall system of claim 1, wherein each of the T-shaped blocks and the complementary blocks has a protruding top engagement on a top of the blocks at the second end and a recessed bottom engagement on a bottom of the blocks in the leading edge of the second end that engages with the protruding top engagement of an overlying block.

5. The block wall system of claim 1, wherein each of the T-shaped blocks has a ground anchor receiving hole extending therethrough for receiving a ground anchor.

6. The block wall system of claim 5, wherein the ground anchor receiving hole is positioned in the head of each T-shaped block and is angled downwardly from a top to a bottom of the T-shaped block.

7. The block wall system of claim 1, wherein each of the complementary blocks has a ground anchor receiving hole extending therethrough for receiving a ground anchor.

8. A method of building a block wall, comprising the steps of:

placing a first row of a plurality of T-shaped blocks and a plurality of complementary blocks on an area of ground in an alternating pattern such that each T-shaped block is adjacent a complementary block and each complementary block is adjacent a T-shaped block, the T-shaped blocks having a head defining projecting load shoulders and a shaft having a first end attached to the head and a second end and a plurality of complementary blocks having a first end and a second end, each of the complementary blocks being shaped to fit securely between a pair of adjacent T-shaped blocks with the first end of each complementary block abutting the load shoulders of the T-shaped blocks, wherein the shaft of each of the T-shaped blocks is wedge-shaped with the width of the shaft being narrower at the first end than at the second end, and the width at the first end of the complementary blocks being wider than the width at the second end, the complementary blocks being shaped to fit between a pair of adjacent T-shaped blocks with opposed sides of the wedge block abutting the shaft of the T-shaped blocks to limit relative movement in a second axial direction; and placing additional rows of T-shaped blocks and complementary blocks on top of a preceding row to build the wall in an upwards direction.

9. The method of building a block wall described in claim 8, wherein a first transverse channel is positioned in the shaft of the T-shaped blocks and a second transverse channel is positioned through the complementary blocks, the first transverse channel and the second transverse channel being axially aligned when the T-shaped blocks and complementary blocks are interlocked.

10. The method of building a block wall described in claim 9, wherein an elongated reinforcement member is positioned through the axially aligned first transverse channel and second transverse channel.

11. The method of building a block wall described in claim 9 further comprising the step of positioning an elongated reinforcement member through the axially aligned first transverse channel and second transverse channel.

12. The method of building a block wall described in claim 8, wherein each of the T-shaped blocks and the complementary blocks has a protruding top engagement on a top of the blocks at the second end and a recessed bottom engagement on a bottom of the blocks in the leading edge of the second end that engages with the protruding top engagement of an overlying block.

13. The method of building a block wall described in claim 8, wherein each of the T-shaped blocks has a ground anchor receiving hole extending there through for receiving a ground anchor.

14. The method of building a block wall described in claim 13, wherein the ground anchor receiving hole is positioned in the head of each T-shaped block and is angled downwardly from a top to a bottom of the T-shaped block.

15. The method of building a block wall described in claim 13 further comprising the step of anchoring the T-shaped blocks to the ground using a ground anchor.

16. The method of building a block wall described in claim 8, wherein each of the complementary blocks has a ground anchor receiving hole extending there through for receiving a ground anchor.

17. The method of building a block wall described in claim 16 further comprising the step of anchoring the complementary blocks to the ground using a ground anchor.

* * * * *